US009888797B2

(12) United States Patent
Edry

(10) Patent No.: US 9,888,797 B2
(45) Date of Patent: Feb. 13, 2018

(54) DUAL-PURPOSE DISPENSING CONTAINER AND UTENSIL

(71) Applicant: NAVIGAZO LTD, Yavne (IL)

(72) Inventor: Yosef Edry, Yavne (IL)

(73) Assignee: NAVIGAZO LTD., Yavneh (IL)

( * ) Notice: Subject to any disclaimer, the term of this patent is extended or adjusted under 35 U.S.C. 154(b) by 239 days.

(21) Appl. No.: 14/452,551

(22) Filed: Aug. 6, 2014

(65) Prior Publication Data

US 2015/0075006 A1 Mar. 19, 2015

Related U.S. Application Data

(60) Provisional application No. 61/862,983, filed on Aug. 7, 2013.

(51) Int. Cl.
*A47G 21/04* (2006.01)
*A47G 21/00* (2006.01)

(52) U.S. Cl.
CPC ..... *A47G 21/04* (2013.01); *A47G 21/004* (2013.01)

(58) Field of Classification Search
CPC ..... A47G 21/004; A47G 21/04
See application file for complete search history.

(56) References Cited

U.S. PATENT DOCUMENTS 2,252,119 A * 8/1941 Edmonds ..... A61J 7/0023 141/25
3,428,460 A * 2/1969 Ely ..... A47G 21/004 426/112
4,830,222 A * 5/1989 Read ..... B65D 35/28 222/106
4,841,637 A * 6/1989 Scholzen ..... A47G 21/004 30/125
4,888,188 A 12/1989 Castner, Sr. et al.
4,891,232 A 1/1990 Dahl
5,277,103 A * 1/1994 Cox ..... A47G 19/16 206/541
5,440,976 A 8/1995 Giuliano et al.
(Continued)

FOREIGN PATENT DOCUMENTS

GB 2 373 710 A * 10/2002
WO WO 2015/019352 A3 * 2/2015

*Primary Examiner* — Hwei C Payer
(74) *Attorney, Agent, or Firm* — The Roy Gross Law Firm, LLC; Roy Gross

(57) ABSTRACT

Disclosed are dual-purpose dispensing containers and utensils for dispensing measured amounts of beverage or food ingredients, useful for the preparation and consumption of the beverages and foods. A dual-purpose dispensing container and utensil comprises a handle having a functional part at first end thereof, the functional part configured for preparing and/or consuming a beverage or foodstuff, at least two compartments extending from a lower surface of the handle and along a longitudinal length of the handle from a second end of the handle opposite the first end. Each two neighbor compartments are spaced apart a pre-selected distance from each other. A cover is attached to the handle along a perimeter of a top opening of each one of the compartments on an upper surface of the handle. Each compartment is configured to contain ingredient for dispensing into a liquid beverage or solid foodstuff for preparing the liquid beverage or solid foodstuff.

22 Claims, 15 Drawing Sheets

(56) References Cited

U.S. PATENT DOCUMENTS

| | | | | |
|---|---|---|---|---|
| 5,873,483 | A * | 2/1999 | Gortz | B65D 77/2056 206/469 |
| 6,569,539 | B2 * | 5/2003 | Bentmar | B32B 27/10 428/480 |
| 6,675,482 | B1 | 1/2004 | Gilbert, Jr. et al. | |
| D487,397 | S * | 3/2004 | Peghini | D9/696 |
| D636,890 | S * | 4/2011 | Teys | D24/224 |
| 8,091,242 | B2 * | 1/2012 | Teys | A47G 21/004 206/532 |
| 8,528,736 | B2 * | 9/2013 | Teys | A47G 21/004 206/532 |
| 2003/0226448 | A1 | 12/2003 | Cohen | |
| 2008/0072432 | A1 | 3/2008 | Teys et al. | |
| 2009/0294454 | A1 * | 12/2009 | Harding | A47G 21/004 220/574.1 |
| 2010/0116772 | A1 | 5/2010 | Teys et al. | |
| 2010/0270330 | A1 * | 10/2010 | Caldwell | B65D 21/0202 222/107 |
| 2010/0325895 | A1 * | 12/2010 | Geissler | A47G 21/004 30/123 |
| 2011/0024462 | A1 | 2/2011 | Teys et al. | |
| 2011/0200713 | A1 | 8/2011 | Simone et al. | |
| 2012/0213891 | A1 | 8/2012 | Simone et al. | |
| 2015/0075006 | A1 * | 3/2015 | Edry | A47G 21/004 30/125 |

* cited by examiner

DUAL-PURPOSE DISPENSING CONTAINER AND UTENSIL

TECHNICAL FIELD

The present invention pertains to dispensing containers. Particularly, the present invention pertains to dual-purpose dispensing containers for dispensing measured amounts of beverage or food ingredients, and which are useful as utensils for preparing and consuming the beverages and foods.

BACKGROUND

The modern lifestyle continuously brings about changes in the needs and habits associated with consumption of foodstuff and beverages. Customized food and drink packaging containing single or limited number of servings is an example of how consumables are adjusted to meet the schedule, activities and habits resulting from the modern way of life. Further, the more a situation or activity is characteristic of modern lifestyle, the more the food or beverage packaging is customized to meet the requirements dictated by that particular situation or activity. For example, the packaging should fit precisely to the amount of beverage or food intake specified for that situation or activity. Particularly, small packaging of ingredients such as sugar, coffee powder, tea leaves, cream, soup powder or concentrate, are used for preparing a single or limited number of beverage or meal servings for relatively short traveling time.

In a further step, dry ingredients of a certain foodstuff or beverage are incorporated into utensils that are used to prepare and consume the serving. Exploiting an integral or designed volume within a utensil for storing ingredients for preparing foodstuff or beverage absolves the need for separate packaging of the ingredients. Such dual-purpose utensils provide a more economic, customized and convenient packaging solution, which is useful especially in situations requiring the handling of a small number of items.

The current literature offers various solutions for dual-purpose utensils, spoons in particular, each solution providing its own design for accommodating consumables within the utensil and dispensing them. The most common mode of including particular ingredients within a utensil is in the utensil handle. If a spoon is used, then the spoon bowl may also include part or all of the ingredients used for preparing the beverage or food serving.

US 2010/0116772 describes a dispensing utensil having a hollow space within the handle of a spoon for accommodating dispensable food ingredients. The top wall of the handle is pliable and can be easily removed, exposing the ingredients within the volume of the handle.

U.S. Pat. No. 6,675,482 describes a spoon bowl in communication with a syringe, such that the solution within the volume of the syringe is injected into the bowl.

In U.S. Pat. No. 8,091,242, the hollow handle of a spoon is divided in two by a partition extending along the longitudinal length of the handle. The top wall of the handle is pliable or attached to a hinge, which when peeled off or pressed, respectively, exposes the contents in the two parts of the handle cavity.

US 2012/0213891 describes a spoon having a bowl covered by a top covering. The bowl and top covering define a space for filling a mixture for preparing a beverage when immersed in a liquid. The covering is made of a porous material or designed in a porous fashion to enable diffusion of the mixture into the liquid and vice versa. The spoon may also comprise a hollow handle with internal space to accommodate ingredients for preparing beverages. Part of the wall of the handle is made of a water soluble polymer, shaped as round coverings spaced apart of each other around and along the wall. These polymer coverings dissolve when the handle is immersed in aqueous liquid for stirring, thereby releasing the content of the handle into the liquid. The wall of the handle may also be partitioned horizontally to accommodate more than one ingredient.

WO 99/44482 describes a spoon with a hollow handle, which incorporates consumable substance. The end of the handle, distal to the spoon bowl is in the form of a cork screwed to the handle. Removing the cork from the handle enables dispensing the content within into a beverage or food.

FR 2 622 424 describes a spoon having a hollow handle, which defines a space for accommodating food or powder ingredients. The handle and spoon bowl are covered by a single peelable covering, which when removed exposes the food or powder inside. The food or powder may then be dispensed into a food or consumable liquid in another utensil.

U.S. Pat. No. 4,830,222 describes a baby feeding spoon with a hollow handle, which communicates with the spoon bowl through a severable partition at the interface between the handle and bowl. The top cover of the handle is squeezable, which enables advancing the food into the spoon bowl by pressing on the top wall of the handle.

CN 202312636 and CN 20216110 describe spoons with hollow handles, having openings at the top or bottom of the handle, respectively. Thus the content within the handle may be dispensed by turning the spoon upside down in the first case or letting it out right to the spoon bowl in the second case.

The solutions detailed above are all aimed at exploiting the internal volume of an expanded handle to accommodate food and beverage ingredient ready to be dispensed upon use. Although in some of the designs, the handle may be partitioned to accommodate more than one type of ingredient, they do not provide a user with the convenience of controlling the order of incorporating these ingredients into a beverage or food or incorporating them at all. Additionally, the use of the internal volume of a handle requires that the handle be bulky in order to accommodate several kinds of ingredients at usable amounts. Otherwise, the handle cannot contain substantial amounts of such ingredients and the spoon may not be efficiently used for this purpose.

It is, therefore, an object of the present invention to provide a dispensing container, which resolves the problems arising from current designs of dispensing containers.

Yet, it is another object of the present invention to provide a dispensing container with separate compartments containing food or beverage ingredients, accessed and dispensed controllably, selectively and separately of each other.

This and other objects of the present invention will become apparent as the description proceeds.

SUMMARY

In one aspect, the present invention provides a dual-purpose dispensing container and utensil (also termed "utensil", "dispensing utensil" and "dual-purpose utensil" throughout the description for brevity), which contains ingredients for preparing food or beverage, where the dispensing utensil is also used in preparing and consuming the food or beverage. In particular, the ingredients are contained in compartments spaced apart of each other in the dispensing utensil.

In one particular embodiment, the volume of each of the compartments containing the ingredients is defined by a base, top and side walls separate from the base, top and side walls of a neighbor compartment.

In still another particular embodiment, the compartments are aligned along the length of a handle of the dispensing container. In still another particular embodiment, the compartments are situated at the lower surface of the handle, extending downwards relative to the surface, which faces a user upon holding the dispensing container.

In still another particular embodiment, the compartments are integrated with the handle, thus forming a continuous structure.

The top surface of the handle provides access to the contents within the compartment through openings spaced apart of each other along the length of the handle. In one particular embodiment, each one of the openings is closed by a cover separate from the cover of any neighbor opening. Further still, each one of the covers is removable off of the opening separately and independently from the covers closing all other openings. This configuration provides the advantage of controlling the handling and dispensing of each one of the ingredients in the compartments separately from the other ingredients. Accordingly, the preparation of a food or beverage becomes a multi-step process controlled and dictated by the desire of a user to introduce the particular ingredient into the consumable solid, liquid or other form of consumable medium.

The cover is attached to the perimeter surrounding an opening of a compartment, the attachment may be done with any acceptable means. One particular, non-limiting example is adhesives, which provide tearable contact with the upper surface of the handle, which forms the perimeter of the compartment opening. In another non-limiting example, the cover may be soldered to the perimeter of the opening, using for example local heating of the material from which it is made in order to bond it to the upper surface of the handle. The strength of the soldering of the cover to the surface of the handle is strong enough to retain it in closed position, the cover being configured to be peeled off upon application of a tearing force removing it up and away from the surface. Still another mode of attachment of the cover to the handle's surface may be by providing a line of weakening around part or the entire length of the perimeter surrounding the opening of a compartment. The line of weakening guides the removal of a cover along a defined track, thereby preventing it from tearing in undesired places such as the middle of the cover. Accordingly, the line of weakening provides a defined track for controllable removal of the covering from the upper surface of the handle. As a result it acts as a safety barrier from undesired, uncontrollable spillage of the content of a compartment to the surrounding. In one particular embodiment, the line of weakening may be combined with an adhesive spread along the track of the line around the perimeter of an opening. The adhesive provides additional strength to the bond between a cover and the handle's surface along the desired track, however allows the tearing of the cover only along this track.

In still another particular embodiment, the cover comprises cross-shaped lines of weakening intersecting at the middle of the cover and which are tearable upon squeezing the walls and base of a compartment towards the opening. The cover is configured to comprise a sufficient level of flexibility that enables it to respond to the pressure exerted by the content of the compartment squeezed towards it and be pushed away. At a certain level of pressure, the cross-shaped lines of weakening surrender and tear, allowing the content within the compartment to be controllably expelled out into a beverage or meal in another container.

In all embodiments of the cover, the cover may be only partially detached from the surface of a handle along a perimeter around an opening of a compartment. This may be achieved by applying detachable adhesive to only part of the perimeter around the opening. The remaining part of the perimeter, preferably the edge(s) distant from the initial point of detachment of the cover from the surface of a handle, may be more strongly welded to the surface of the handle. Thus, when removing the cover from the opening, the cover remains partially attached to the handle of the utensil. This imparts the benefit of retaining all single-use disposable parts of the utensil together, which in turn makes it easier to dispose of all parts of a single-use utensil without picking and gathering them back together after use.

In still another embodiment, the cover may be made from any material configured to adhere or be welded to the surface of the utensil's handle and provide adequate sealing to the content in the compartment. In particular, the material of the cover may be selected from synthetic materials, such as cellulose, olefin polymers such as ethylene or propylene polymers, styrene polymers, ethylene terphthalate polymer, vinyl polymers and carbonate polymers. In still another particular embodiment, the cover may be made from cardboard or aluminum foil, configured to provide proper sealing to the content in the compartment. In one particular embodiment, the volume of a compartment is sufficient to contain a measured amount of an ingredient used for preparing a beverage or meal. In particular, such amount may be sufficient for preparing a single serving of the beverage or meal. This, however, does not exclude the possibility of designing the volume of a compartment to contain measured amount of ingredient with supplemental amount or double the amount for preparing a single serving of beverage or meal. Still, the design of anyone of the compartments is not limited by the measured amount of any of the ingredients contained within the compartments volume. Accordingly, the volume of a compartment may be designed to contain any measured amount of an ingredient as desired.

In still another particular embodiment, the compartments are aligned along the length of the handle of a utensil with defined spaces between them. Accordingly, each compartment is defined by its own independent walls, base and top without interfacing with neighbor compartments.

The number of compartments may vary. Particularly, the number of compartments may be determined according to the number of ingredients required for preparing a particular beverage or food. For example, sugar, coffee powder and cream ingredients may be provided in three separate compartments extending from the handle of a spoon design of the dispensing utensil for preparing a coffee cup. Another example, is tea leaves, sugar and cream also provided in separate compartments in a spoon design of the dispensing utensil for preparing a tea cup. Other examples of dispensing utensil designed according to the type of beverage or food comprise soup ingredients such as soup concentrate powder, salt and pepper, or baby formula powder both in a spoon design of the dispensing utensil.

It should be emphasized that the design of the dispensing utensil is not limited to a spoon. It is well within the scope of the present invention that other designs such as fork, knife or any kitchenware or tableware may be provided with a compartment or compartments integrated with the handle of the dispensing utensil, the compartment or compartments containing the ingredients for preparing the particular beverage or meal served to a consumer. Non-limiting examples are food concentrates, spices and dressings contained in separate compartments integrated with the handles of a knife and fork utensils used for eating a meal.

In view of the above, it is clear that the number of compartments as well as the size of the dispensing utensil may be configured to meet the need for preparing and consuming a particular beverage or food. Therefore, the number of compartments may vary between two and any other number that matches the number of ingredients required for a particular beverage or food. Further, the size of the dispensing utensil may also be designed to fit the amount of ingredient or ingredients required and the number of ingredients.

The shape of the dispensing utensil and the compartments included in it may be designed according to any functional or ornamental requirement. As demonstrated in the attached Figures and explained in the following, the design of the handle and compartment may take any form suitable for holding the dispensing utensil and accommodating the beverage or food ingredients. Particularly, the handle may comprise free space between the compartments or at its end distal from the functional part of the utensil for holding the dispensing utensil conveniently.

In one particular embodiment, the space between compartments is configured to meet functional requirements such as the desired size of the utensil, free space on the handle, which is available and sufficient for holding by hand of a user and free available space on the handle for hanging the utensil on a tableware stand. The handle itself, however, with the expanded compartments may provide sufficiently convenient area for holding when preparing and consuming the beverage or food.

In another aspect, the present invention provides a kit of dual-purpose dispensing containers and utensils, which comprises tableware required for consuming beverages and foodstuff. Particularly, the utensils comprise compartments that contain ingredients necessary or supplemental to the preparation of beverages and/or foodstuff. Further, the ingredients may be distributed among the compartments on the utensils in a manner that completes a set, which may be used for preparing beverages or foodstuff. Thus, in one non-limiting example, a set of dual-purpose dispensing knife and fork may be used to accommodate basic spices as salt and pepper, dressings and mayonnaise in the compartments in measured amounts to be used in the meal served.

In another non-limiting example, a complete set of dual-purpose tableware may be provided together with a meal including beverage and food servings, where the compartments in the dual-purpose utensils comprise measured amounts of all the spices, ingredients, cream and dressings, which a user may wish to introduce into the beverage and foodstuff served.

In one preferred embodiment, the dual-purpose utensil is single-use ware. Accordingly, the utensil is made of synthetic materials, particularly, polymeric materials. Examples of such materials comprise styrene polymers, particularly polystyrene (PS), olefin polymers, particularly polyethylene (PE) and polypropylene (PP), polyethylene terphthalate (PET), polycarbonate (PC) and trifluoroethylene polymer.

In still another particular embodiment, the dual-purpose utensil is made of bio-degradable polymeric materials.

The utensils of the present invention comprise several distinct parts, namely the handle, compartments for the ingredient and functional part used for preparing and consuming a beverage or foodstuff such as spoon bowl or tea spoon bowl, blade of a knife and teeth of a fork. Therefore, the utensil's parts may be made separately and combined afterwards by heat melting or combining them at the interface between the different parts. Alternatively, in one particular embodiment, the entire utensil is made of a single cast unit.

Filling the compartments of the dual-purpose utensil with any one of the ingredients may be carried out in any industrially available method. Particularly, a compartment may be filled by pouring powder or crystalline ingredients such as coffee or sugar into it and condensing the powder within the volume of the compartment. Further still, the compartment may be pumped to vacuum in order to retain the freshness and quality of the ingredient for a long period of time. After filling is done, the compartment is sealed with a cover, using heat melting along the perimeter of the opening of the compartment or binding with adhesives. Particularly, the adhesives may be environmentally friendly materials, edible adhesives that do not compromise the health of the consumer when accidentally or otherwise coming in contact with an ingredient in a compartment or with the beverage or foodstuff into which they are introduced. Most particularly, the edible adhesives are desirable when hot beverages are prepared. In such preparation the adhesive might be immersed in the hot liquid together with at least part of the handle of the dispensing utensil. Thus, there is increased possibility that the adhesive dissolves in or migrates into the liquid, after which it will be consumed by a user together with the liquid and all other acceptable ingredients introduced.

It should be noted that the dual-purpose dispensing container and utensil is configured to be used for all types of consumable products, liquid and solid. Further, the utensil is also configured to be used at every temperature in which a consumable beverage or food is served. The temperature of the consumable serving does not adversely affect the formation or shape of the utensil or its physical and chemical properties, which makes it safe for use for hot, warm or cold beverages and solid foods.

The following describes non-limiting particular examples of a dual-purpose utensil and parts thereof.

DETAILED DESCRIPTION OF THE DRAWINGS

Figure 1A:
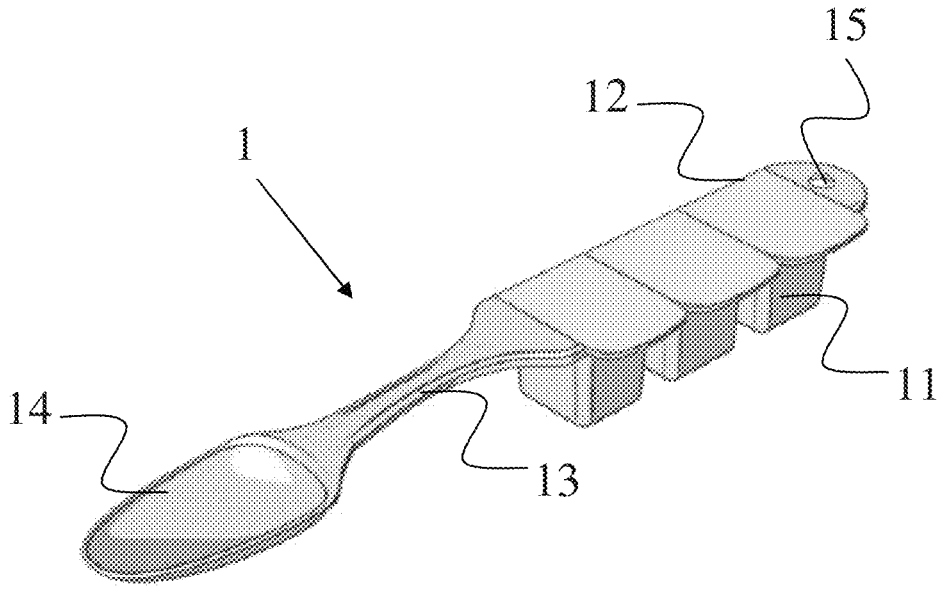
FIGS. 1A-1C illustrate one particular example of the dual-purpose dispensing container and utensil.
Figure 1B:
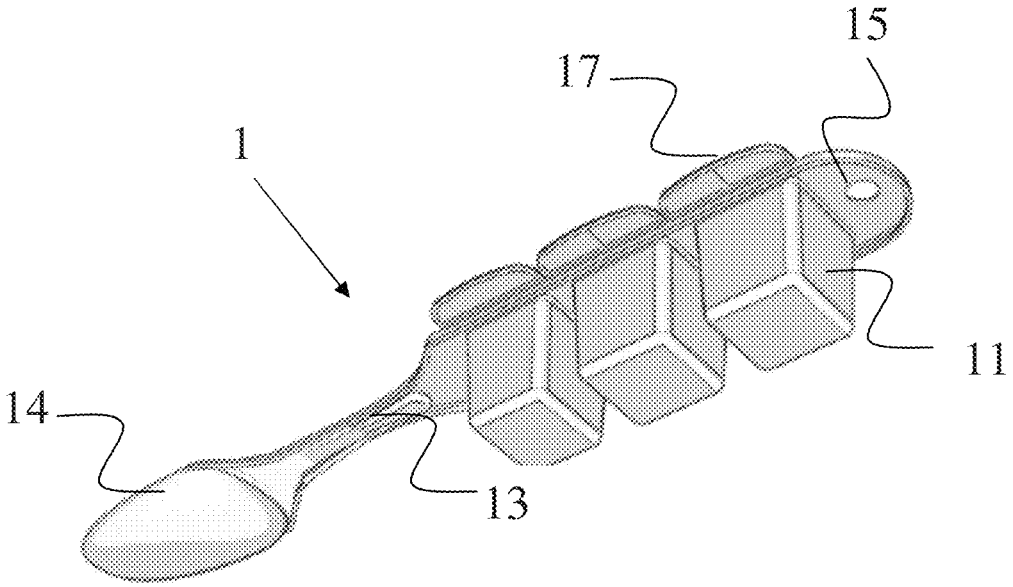
Figure 1C:
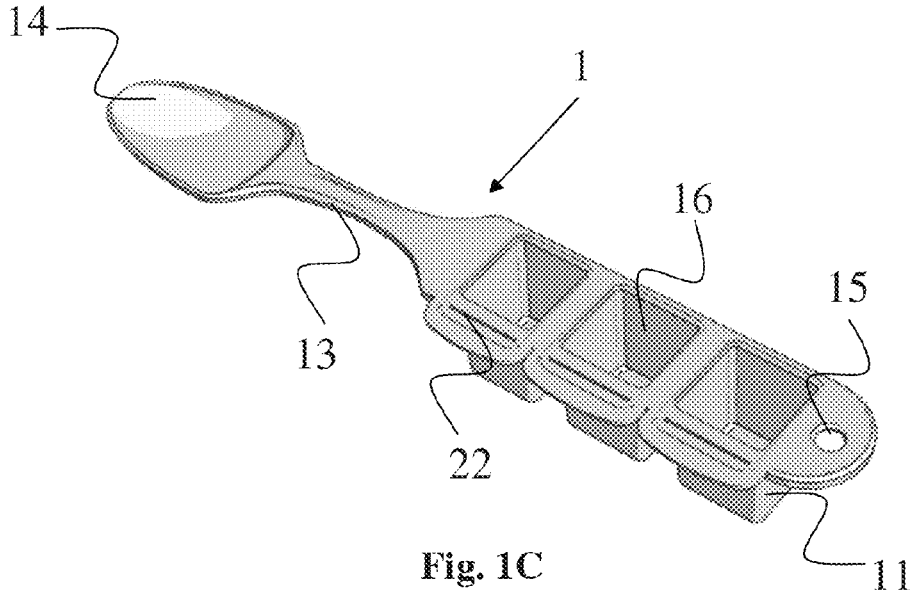
Figure 2A:
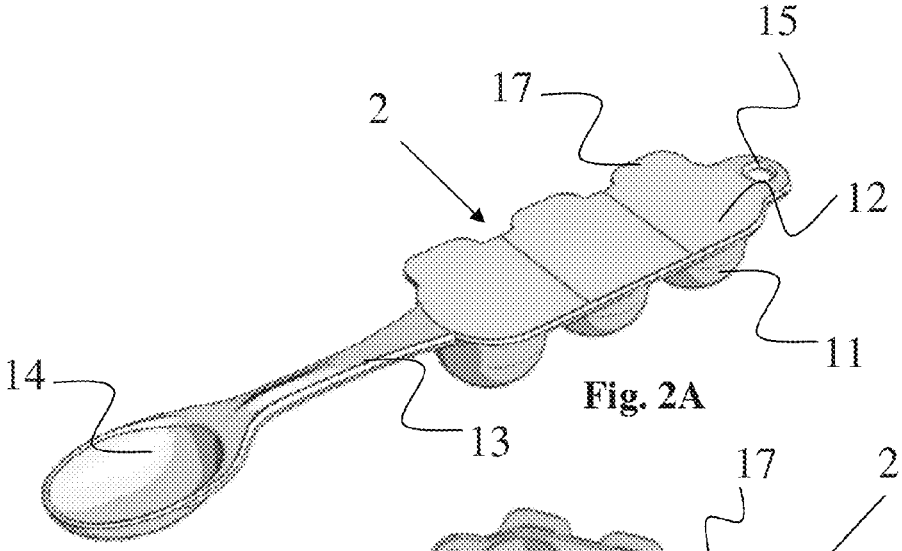
FIGS. 2A-2C illustrate a second particular example of the dual-purpose dispensing container and utensil.
Figure 2B:
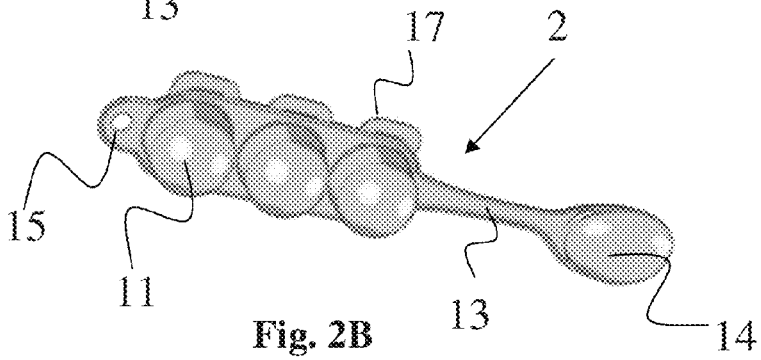
Figure 2C:
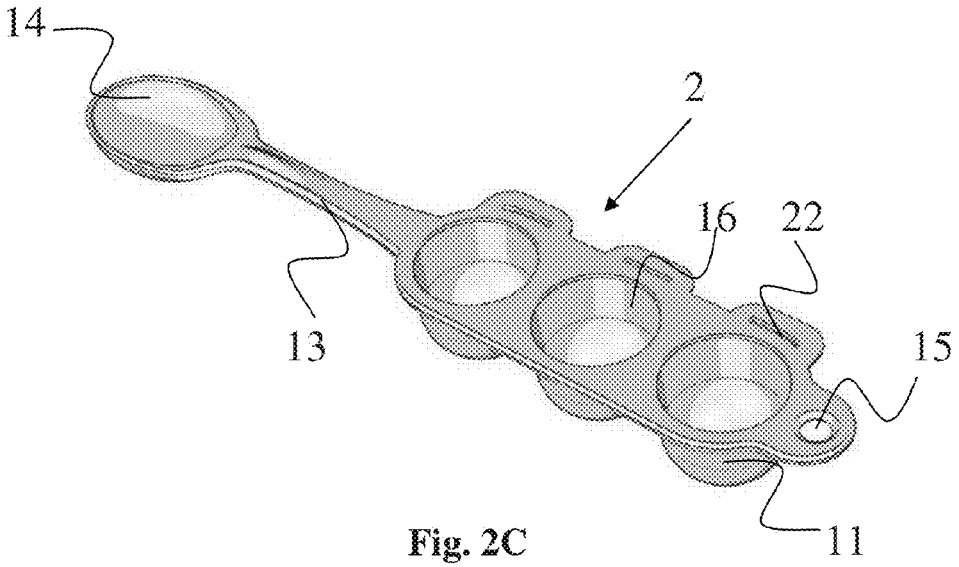
Figure 3A:
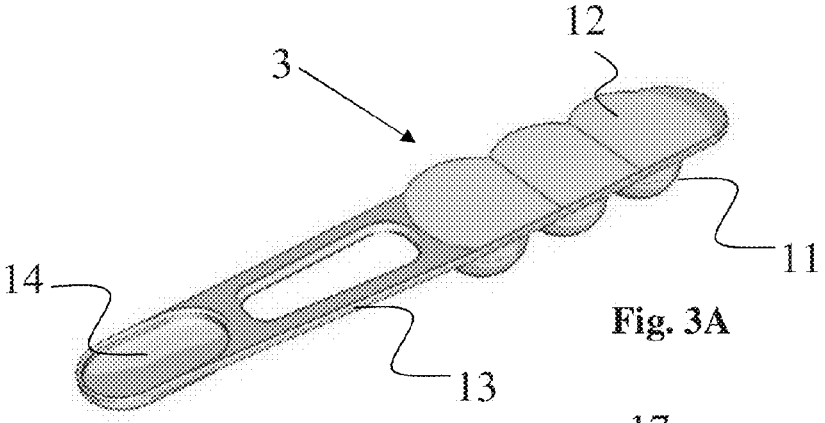
FIGS. 3A-3C illustrate a third particular example of the dual-purpose dispensing container and utensil.
Figure 3B:
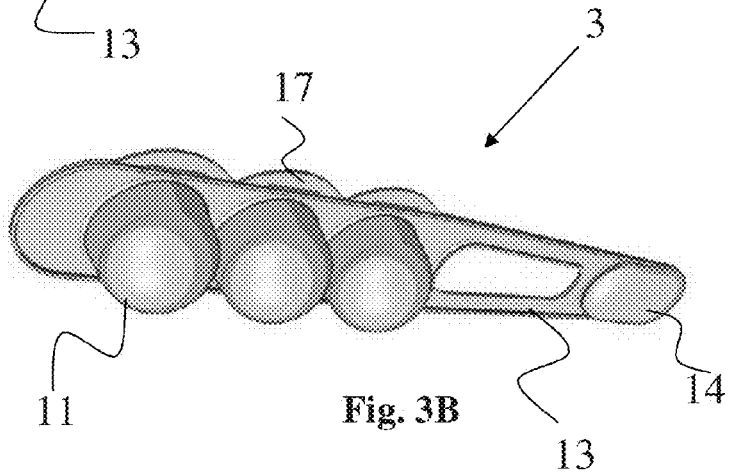
Figure 3C:
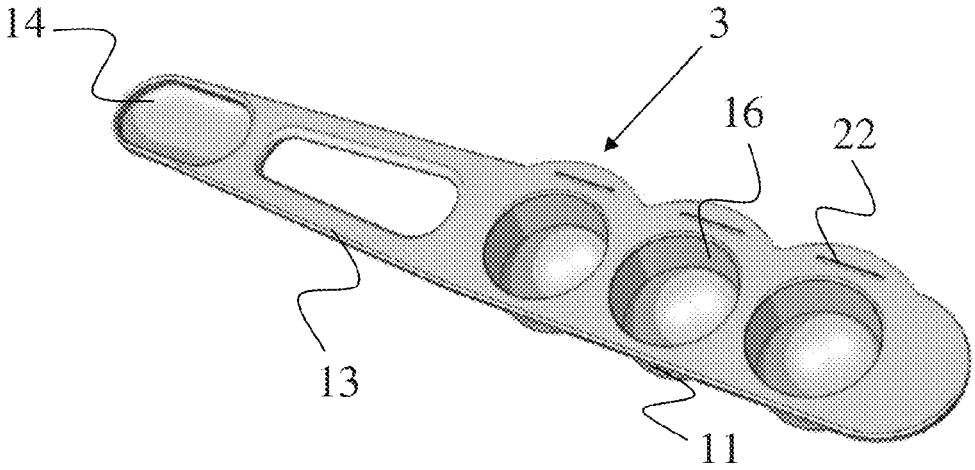
Figure 4A:
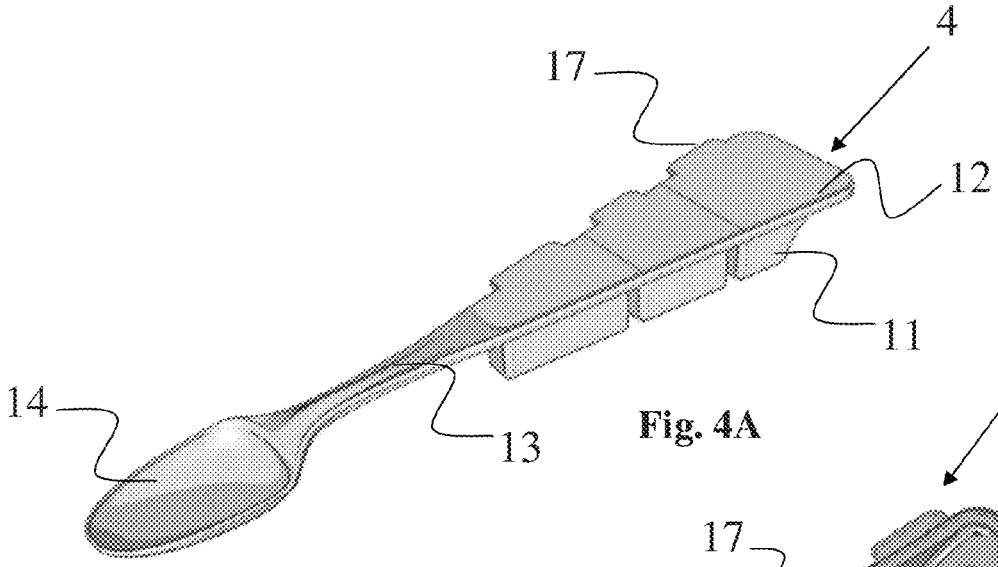
FIGS. 4A-4C illustrate a fourth particular example of the dual-purpose dispensing container and utensil.
Figure 4B:
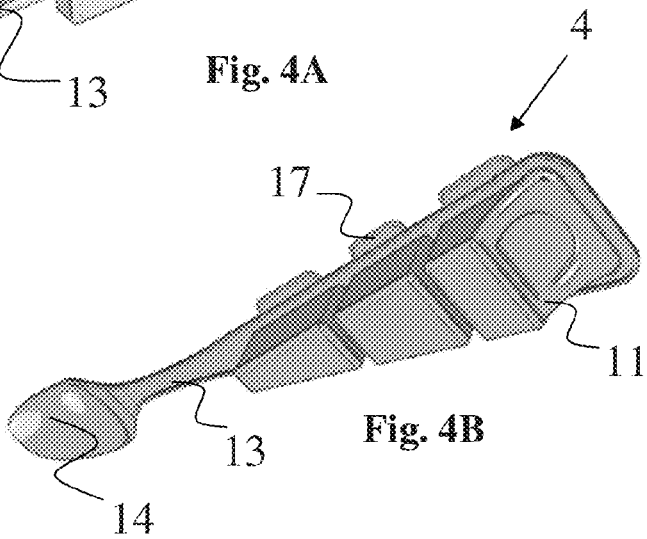
Figure 4C:
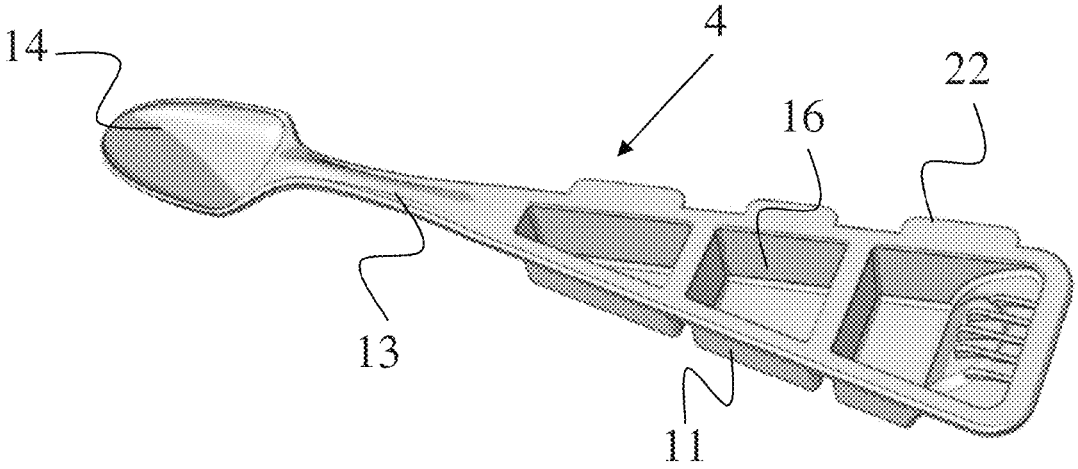
Figure 5A:
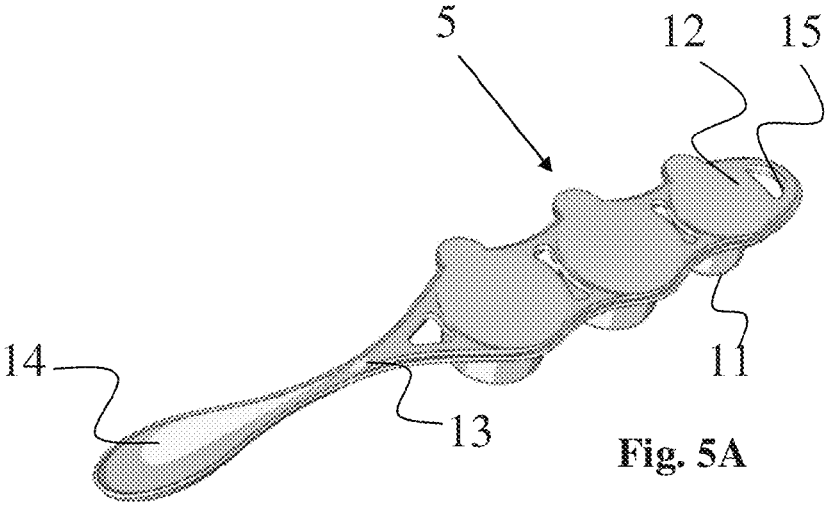
FIGS. 5A-5C illustrate a fifth particular example of the dual-purpose dispensing container and utensil.
Figure 5B:
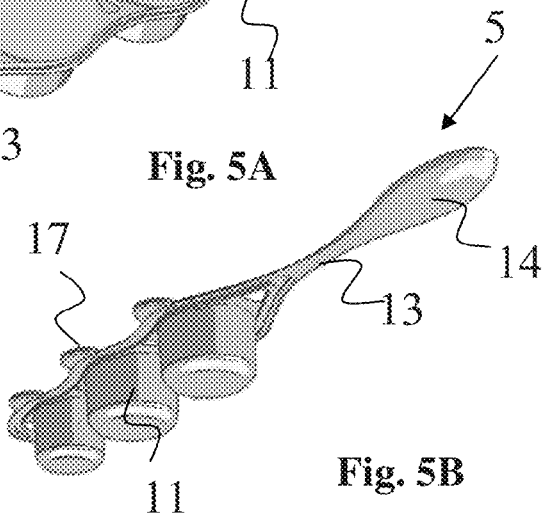
Figure 5C:
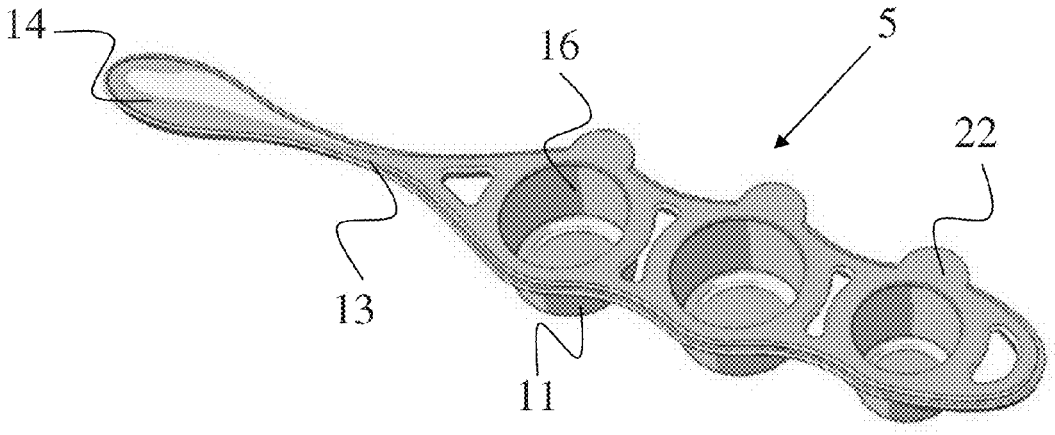

FIGS. 1A-1C through 6A-6C illustrate different example designs of a dual-purpose dispensing container and utensil. Although the shapes of the different parts of these designs are different from each other they comprise the same major parts as described in the following:

Dual-purpose dispensing container and utensils (1)-(5) comprise at least two compartments (11) aligned in along the longitudinal length of handle (13), the handle being connected to a functional part (14) of the utensils (1)-(5). As is clearly seen in all of the designs, the compartments (11) are spaced apart from each other, the volume of each one of them being defined by separate side walls, bottom base and top cover (12). The particular designs in FIGS. 1-6 illustrate particular utensils (1)-(6) having a spoon bowl as the functional part (14). However, the functional part (14) may be selected from a variety of functional parts of any type of tableware independently of all other parts of the utensil. It is clearly seen that the integration of a functional part in the utensil does not adversely affect the functionality of all other parts. Specifically, the handle (13) and compartments (11) including the cover (12) on the compartments are not affected by the replacement of the functional part (14). Therefore part (14) of the utensil can be replaced with any functional part of tableware, available or customized according to specific needs. Specifically, the part (14) can be selected from conventional tableware such as spoon bowl, tea spoon bowl, knife blade and fork teeth.

Some of the designs comprise a hole (15), which may be used to hang them from a hook. This provides a conveniently way for storing and packing a plurality of such utensils in a single packaging when hanged from a single hook. The utensils (1) may then be distributed or taken one after the other off the hook. The hole may further be extended and relocated to a different place of the handle (13) as is illustrated in the design in FIGS. 3A-3C.

FIGS. 1C, 2C, 3C, 4C, 5C and 6C illustrate the interior volume (16) of the compartments (11). It is clear that the shape of a compartment (11) defines the shape of its interior volume (16). However the shape of the internal volume (16) does not affect the functional use of the compartment (11). In any one of the designs, the compartments (11) may be used for filling any one of the ingredients elected or required for preparing a certain beverage or food. Therefore, the parameter that determines the functionality of the compartment (11) is its volume rather than its shape. Generally, the designs in FIGS. 1-6 illustrate cubic, cylindrical and trapezoid compartment (11), which are acceptable shapes for filling it with ingredients. Further, the shapes of the compartments also should not affect the application of hermetic sealing with a cover (12) over the opening of the compartment (11). Rather the perimeter around a compartment (11) determines the possibility of such hermetic sealing. The cover (12) is further equipped with a tab (17), which is used to pull the cover (12) away from the opening of the compartment (11). Such tab (17) may be present as an extension of the opening beyond the borders of the handle. As will be described in the following, the tab may be replaced by another configuration for exposing the content inside the volume (16) of the compartment (11). Such alternative configuration is illustrated in FIGS. 7A-7E. The particulars of the tab (17) configuration are illustrated in FIGS. 9A-9F and will also be described in the following.

Figure 9A:
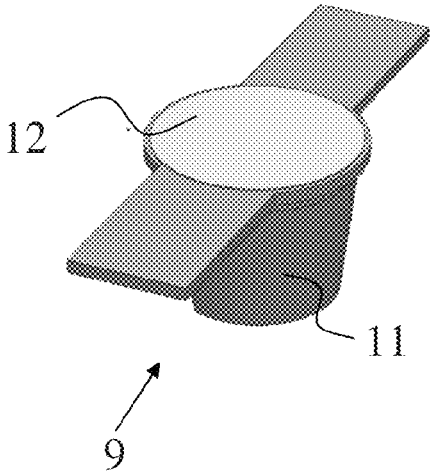
FIGS. 9A-9F illustrate a third particular example of a covering and ingredient compartment.
Figure 9B:
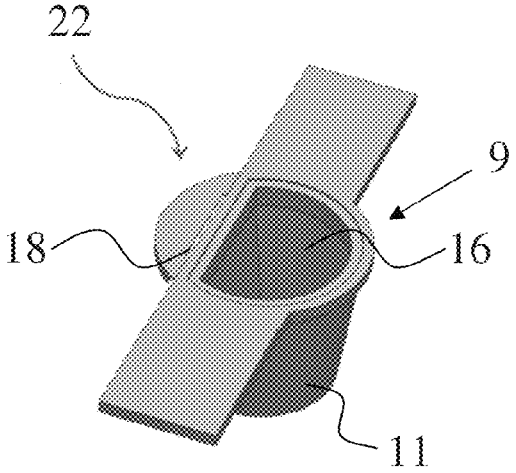
Figure 9C:
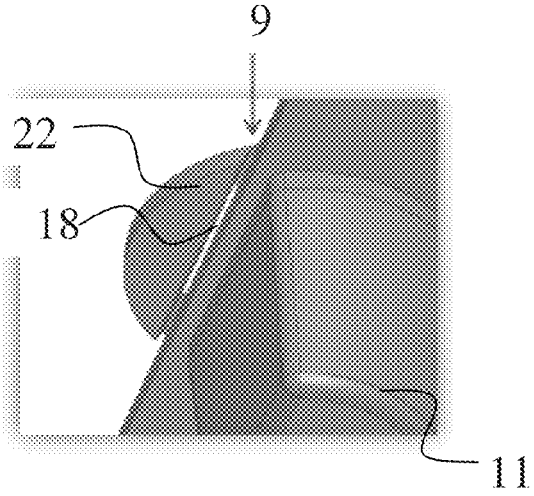
Figure 9D:
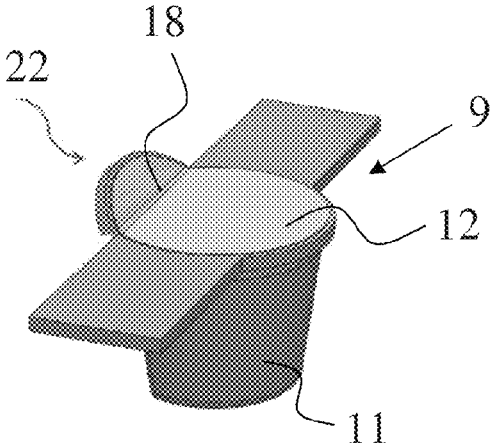
Figure 9E:
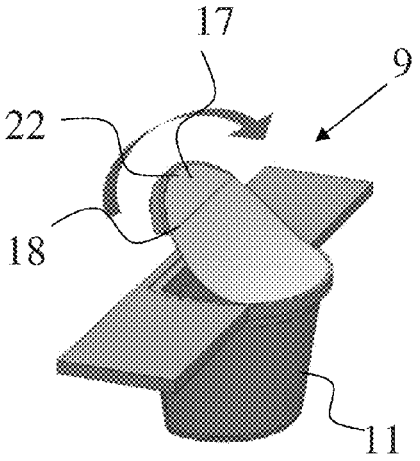
Figure 9F:
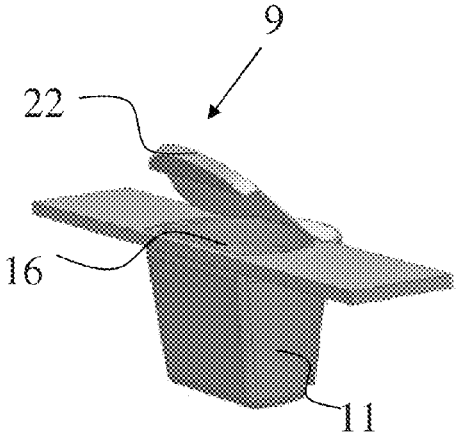
Figure 10A:
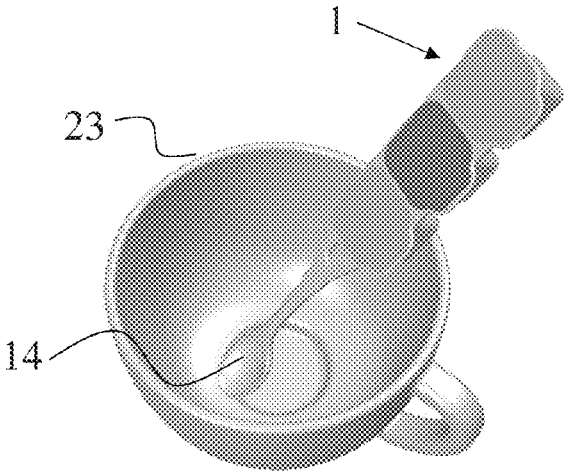
FIGS. 10A-10D demonstrate a particular application of the dual-purpose dispensing container and utensil of the present invention.
Figure 10B:
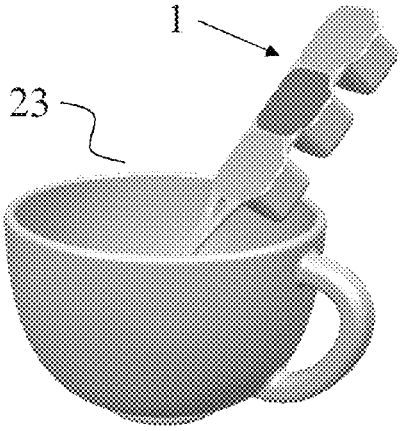
Figure 10C:
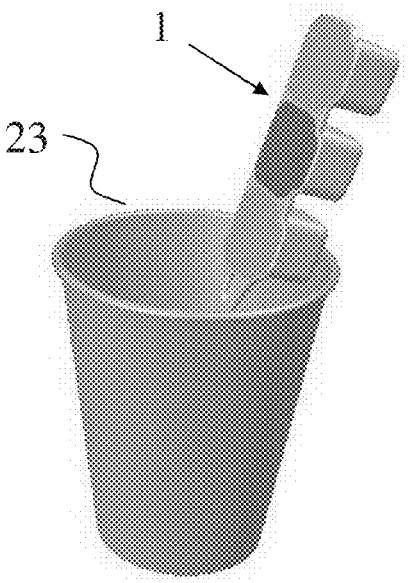
Figure 10D:
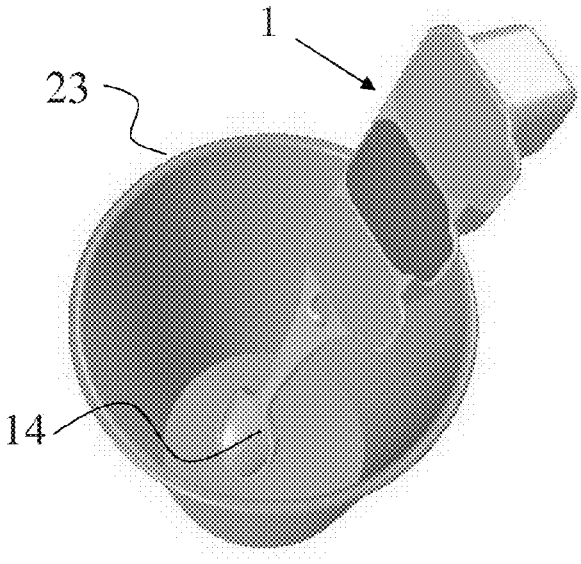

FIGS. 9A-9F illustrate the design (9) and application of a pull-tab in the opening of a cover (12) attached to the top opening of a compartment (11). FIGS. 9A and 9B show the opening of the compartment (11) with and without the cover on its top opening, respectively. This enables showing the placement of the tab (17) relative to the borders of the compartment (11) and handle. FIG. 9B exposes the line of weakening (18) of tab (17 in FIG. 1B) at the interface between the tab border and cover (12). Extension (22) is actually a local side extension of handle (13 in FIG. 1A) that carries an extension of the cover (12) on it. Fracturing the connection of the extension (22) at the line of weakening (18) until complete release from the connection with the handle (13 in FIG. 1A), enables to pull the tab (17 in FIG. 1B) up and away from the utensil (1 in FIG. 1A). Since the cover (12) has a continuous extension (17 in FIG. 1B) over the upper surface of the extension (22), pulling of the extension (22) will also remove the cover (12) off from the opening of the compartment (11) and expose the ingredients contained in the volume (16) therein. This configuration is illustrated in FIGS. 9D through 9F. Lastly, FIG. 9C shows a particular mode of attachment of extension (22) to handle (13 in FIG. 1B) from a bottom perspective. The tab (22) is shown to be connected to the handle (13) only at the extremities. Such connection is sufficient to hold the extension (22) in place until use and easily break upon exposure of the compartment (11 in FIG. 1A) volume (16) and ingredients therein.

Figure 7A:
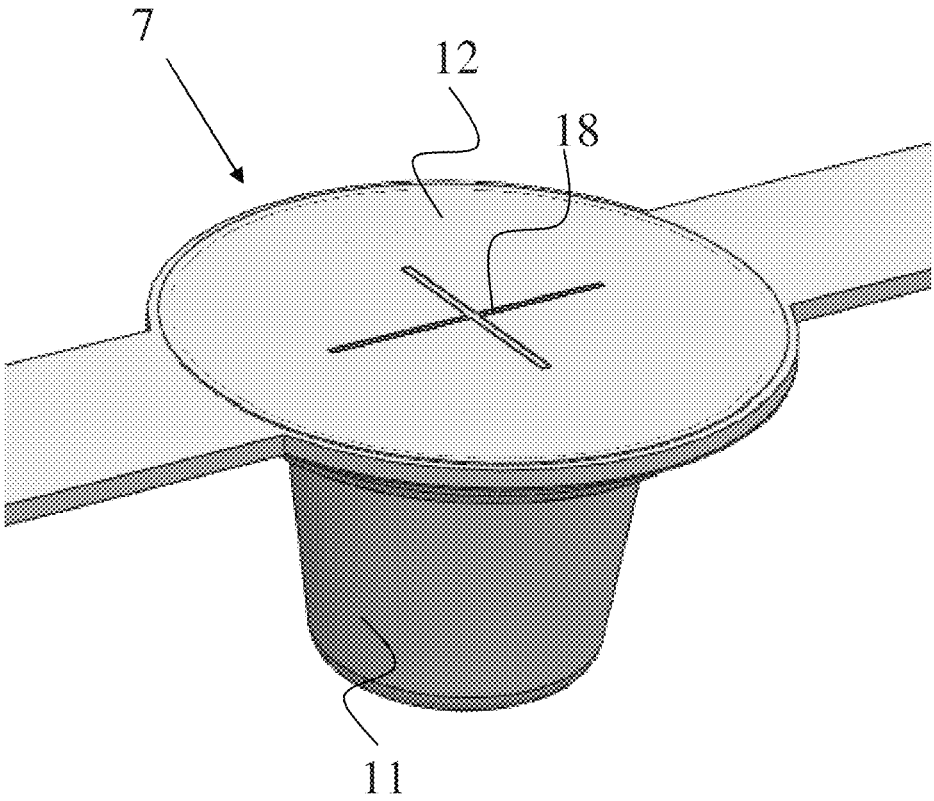
FIGS. 7A-7E illustrate one particular example of a covering and ingredient compartment.
Figure 7B:
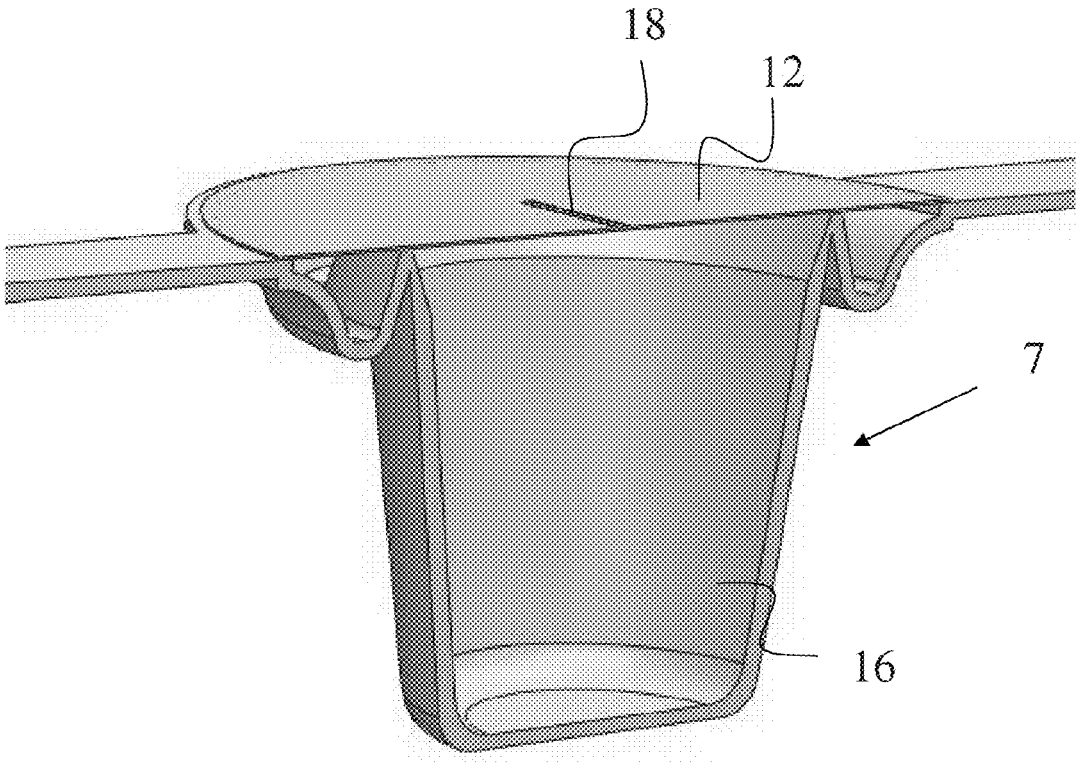
Figure 7C:
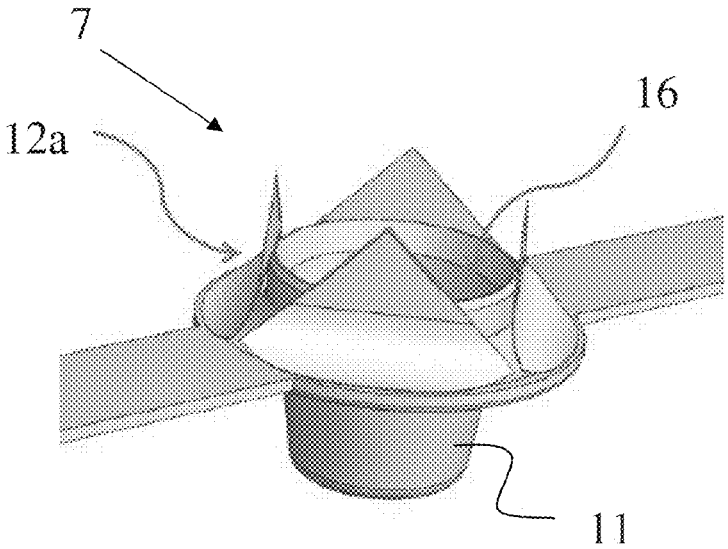
Figure 7D:
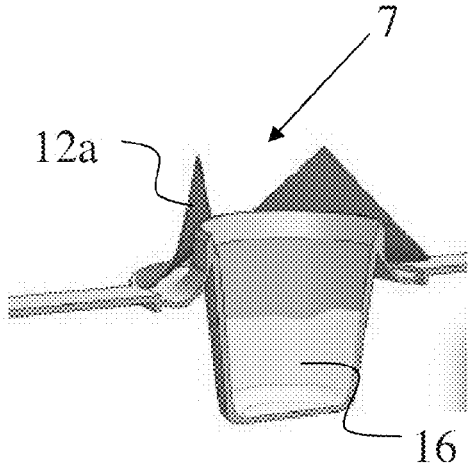
Figure 7E:
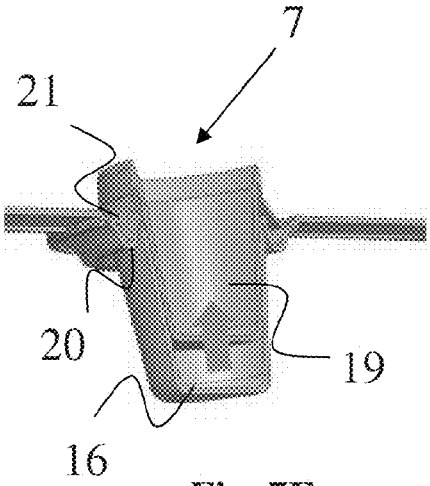

FIGS. 7A-7E and FIGS. 8A-8C show alternative designs of opening a cover (12). The design (7) in FIGS. 7A-7E is cross-shaped lines of weakening (18) at the center of the cover (12). These lines extend away from a center point of the cover (12) and only to a limited length along a diameter, height or diagonal of the cover (12) without reaching the cover edges. The lines of weakening (18) surrender to pressure applied on the side walls and bottom of compartment (11). The compartment (11) in this case is made of a flexible material, which can be squeezed towards the center of the compartment (11), exerting pressure on the ingredients contained within it. In turn, the pressure on the content of compartment (11) creates force on the cover (12), making it to tear and open at its weakest places, namely the cross-shaped lines of weakening (18). FIG. 7B shows a cross section view of the compartment (11 in FIG. 1A), cover (12) and lines of weakening (18). FIGS. 7C-7E show the compartment (11) and cover (12) in full opening state, where the cross-shaped lines of weakening (18) tore the cover (12) to four even triangular shape pieces (12*a*). Particularly, these Figures show a further addition to the basic cross-shape design by adding an internal compartment (19) within the compartment (12). Compartment (19) is forced up upon application of pressure on the bottom and side walls of compartment (11). This causes the top margins (21) of the internal compartment (19) to be lifted away from top margins (20) of compartment (11). Both top margins (20) and (21) surround the perimeter of their respective compartments (12) and (19), respectively, in the form of rails placed one within the other. When pushed outwardly, compartment (19) causes rail (21) also to distance itself from rail (20) attached to compartment (11).

Figure 8A:
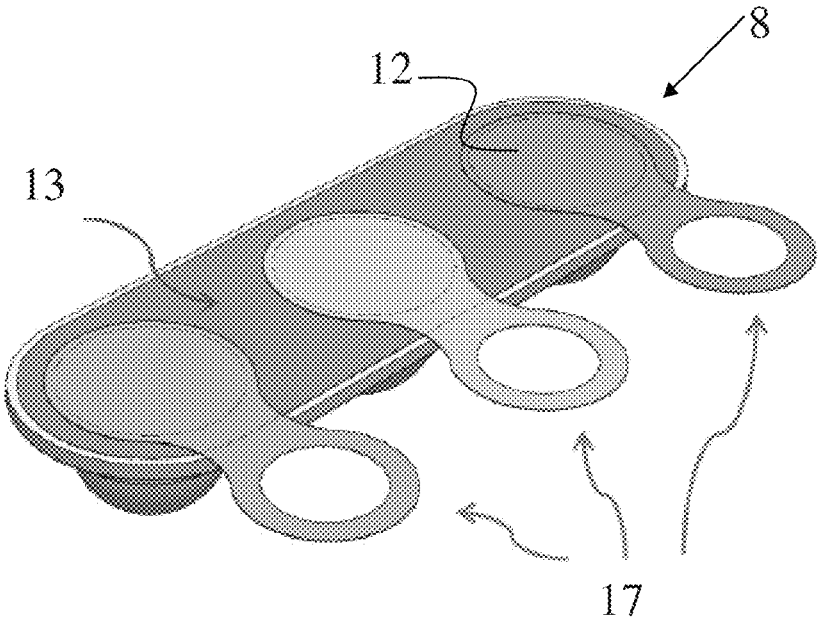
FIGS. 8A-8C illustrate a second particular example of a covering and ingredient compartment.
Figure 8B:
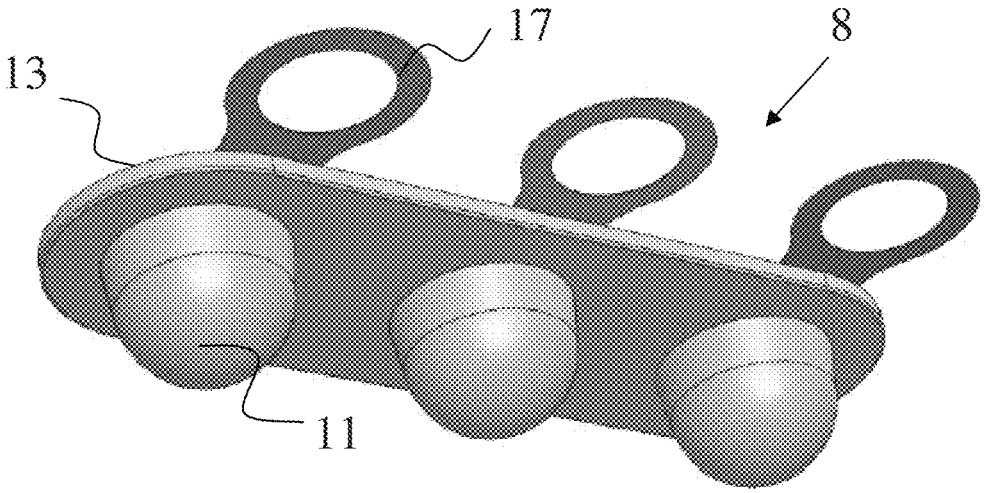
Figure 8C:
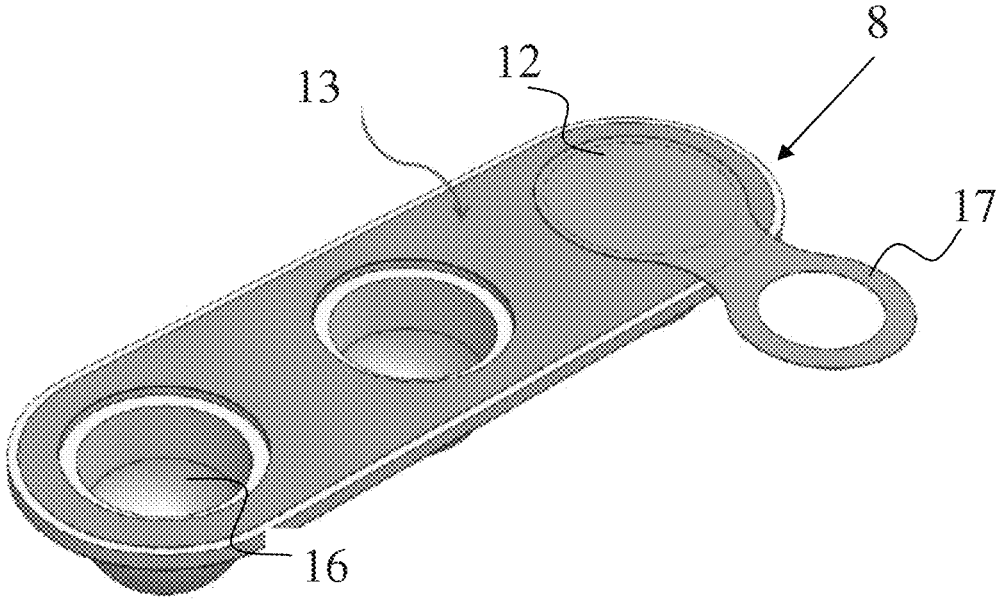

FIGS. 8A-8C illustrate a third alternative of a mechanism (8) for pulling a cover (12) away from a compartment (11) top opening. A ring-shape tab (17) forms an extension to the cover (12). The cover (12) extends beyond the perimeter of the compartment opening towards the border of the handle (13) at the arc that connects with the ring-shape tab (17) as shown in FIG. 8A. The hole of the ring-shape tab (17) is sufficient for efficiently holding the tab using two fingers, particularly thumb and index finger, in order to pull the tab (17) away. Performing such action causes the parts of the cover (12) to gradually detach first from the surface of the handle (13) and then from the perimeter surrounding the top opening of compartment (11). The tab (17) hangs away from the borders of handle (13) and is not attached to it in any way. FIG. 8B shows a bottom view of this design of tab. FIG. 8C illustrates the two situations of a cover (12) and tab (17) closing on the top opening of compartment (11) and the exposed volume (16) of compartment (11) after complete removal of the cover (12) and tab (17).

FIGS. 10A-10D demonstrate how a dual-purpose dispensing container and utensil (1) with a functional part of a spoon or tea spoon bowl (14) is used from different perspectives. The use is actually the same as that of ordinary spoon. However the handle is thicker due to the compartments aligned along its length. The compartments are shown to be closed by the cover, but of course the covers may be left open or completely removed after emptying the content in any one of the compartments into the cup (23). These Figures also show that the lower portion of the handle may enter the space enclosed by the cup (23) and as a result come in contact with a liquid in the cup (23). This does not pose any functional or other problem on the use of the utensil (1), due to its chemical and physical durability, particularly at high temperatures in case of a hot liquid or its chemically inert response to the materials in the liquid.

Figure 6A:
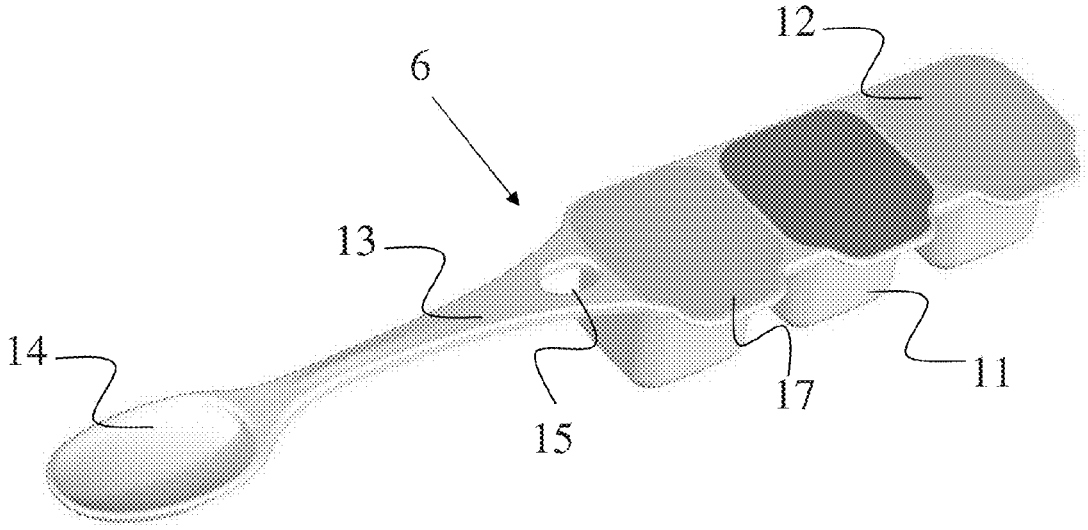
FIGS. 6A-6C illustrate a sixth particular example of the dual-purpose dispensing container and utensil.
Figure 6B:
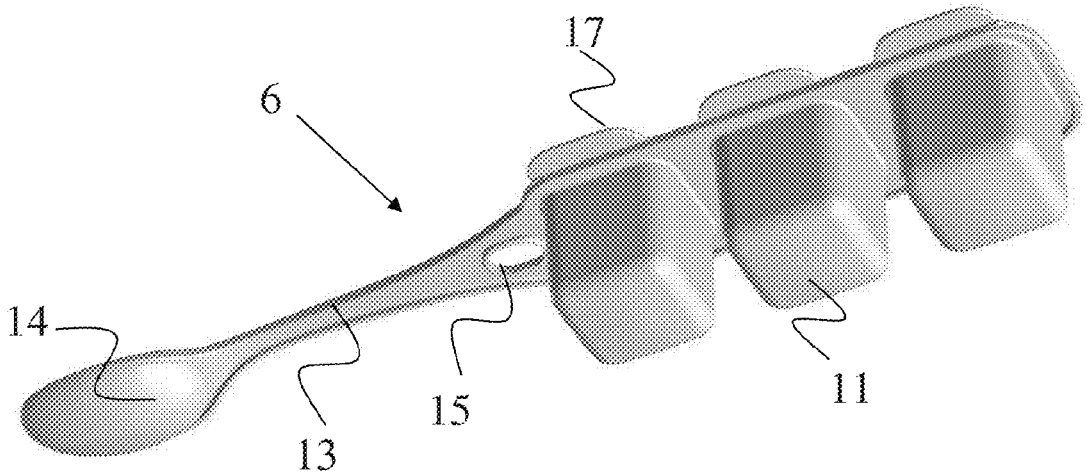
Figure 6C:
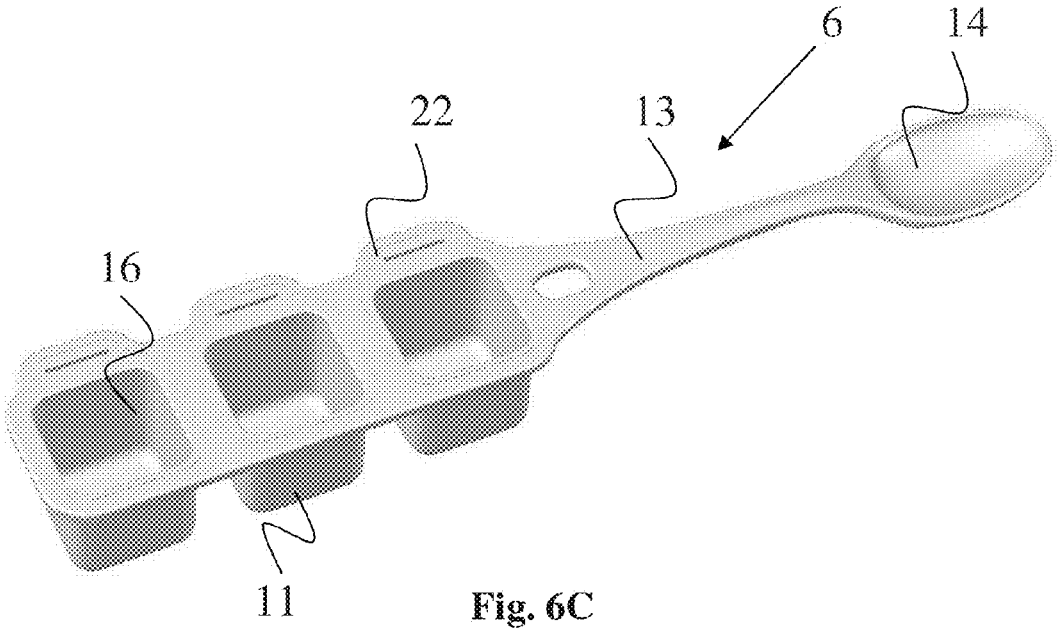

FIGS. 11A-11D define particular dimensions of the design of the dual-purpose dispensing container and utensil (6) illustrated in FIGS. 6A-6C. The different perspectives in FIGS. 11A-11D show the absolute sizes of different parts of the utensil (6) also demonstrating the relations between these sizes. Particularly, the width of a compartment (11) is shown relative to the length of the handle (13) the entire row of compartments occupies. The compartments (11) are spaced apart a distance from each other that can be calculated from the accumulated width of the compartments (11) and the entire end-to-end length that the take from the handle (13). The remaining length of the handle (13), including the functional part (14), i.e. the spoon bowl, is long enough for convenient use such as mixing the ingredients in the compartment (11) in a cup. The height of the compartments (11) is seen longer than the depth of the spoon bowl (14), as may be usually the case. However, this is not a functional or structural requirement of the utensil. It may well be within the scope of the present invention that the ratio between the compartment height and spoon bowl depth is reversed. Particular non-limiting examples are contemplated where only small amounts of ingredients are required for a particular serving or beverage, obviously reducing the size of the compartment. Alternatively, a deeper spoon bowl may be required for serving particular amounts of food such as mush or formula to an infant, resulting in a depth of the bowl larger than height of the compartment.

Figure 11A:
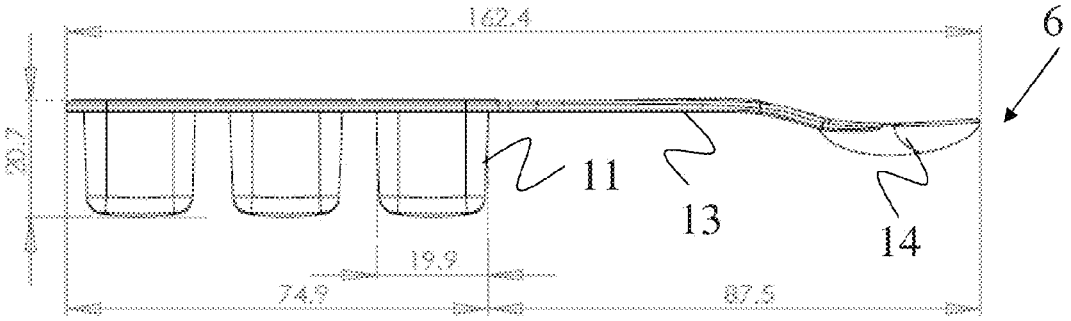
FIGS. 11A-11D illustrate particular dimensions of the dual-purpose dispensing container and utensil of the present invention as illustrated in FIGS. 6A-6C.
Figure 11B:
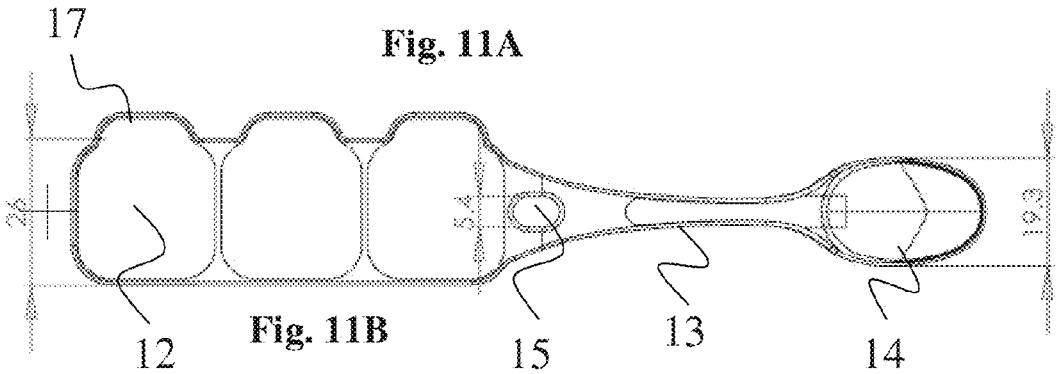
Figure 11D:
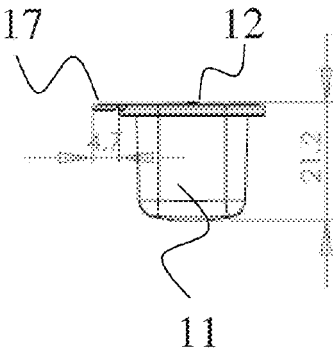
Figure 11C:
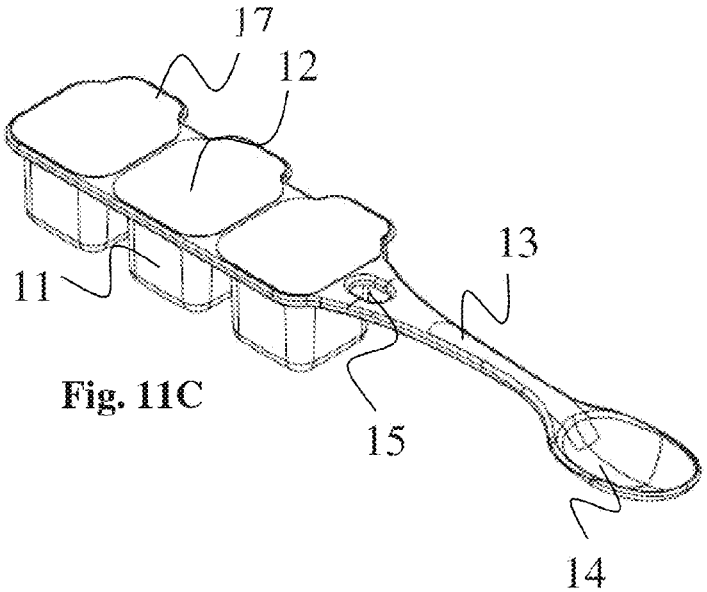

The length of the cover extension (17) (which is overlaid on the extension (22) of the handle (13), not shown) is small relating to the length of the cover (12) as is shown in FIG. 11D. However, the length of both cover and handle extensions, (17) and (22), respectively, is sufficient for manual disconnecting the handle extension from the handle (13) and removing the cover (12) off from the opening of compartment (11).

Although selected embodiments of the present invention have been shown and described, it is to be understood the present invention is not limited to the described embodiments. Instead, it is to be appreciated that changes may be made to these embodiments without departing from the principles and spirit of the invention, the scope of which is defined by the claims and the equivalents thereof.

The invention claimed is:

1. A dual-purpose dispensing container and utensil comprising:

a handle having three apertures each defining an aperture periphery;

a functional part at a first end of said handle, said functional part configured for preparing and/or consuming a beverage or foodstuff;

three neighbor compartments extending downward from a respective one of the aperture peripheries at a lower surface of said handle and along a longitudinal length of said handle from a second end of said handle opposite said first end, said three neighbor compartments are spaced apart a pre-selected distance from each other, such that the three neighbor compartments extend along the longitudinal length of said handle, said three compartments attached to said lower surface of said handle by melt-fusion;

a plurality of covers attached to an upper surface of said handle over the apertures and along a perimeter of a top opening of a respective one of said compartments, each said cover comprising a tab or pull-tab for removing said cover from said handle, the tab or pull-tab extending transversely to the longitudinal length of said handle, wherein each one of said three compartments is configured to contain ingredient for dispensing into a liquid beverage or solid foodstuff for preparing said liquid beverage or solid foodstuff, wherein said compartments are made from a material different from a material of said handle, and wherein each compartment is defined by its own independent walls, base and top without interfacing with its neighbor compartments.

2. The dual-purpose dispensing container and utensil according to claim 1, wherein each one of said compartments is configured to contain measured amount of said ingredient.

3. The dual-purpose dispensing container and utensil according to claim 1, further comprising a hole in said handle, said hole is configured for hanging said container and utensil from a hook and packing a plurality of said dual-purpose dispensing containers and utensils in close packing.

4. The dual-purpose dispensing container and utensil according to claim 1, wherein each said cover comprises cross-shaped lines of weakening extending away from a center of said cover and along a diameter, height or diagonal of said cover, said lines of weakening do not reach the edges of the cover, wherein said compartments are made from a flexible material, said lines of weakening are configured to tear upon application of sufficient pressure applied on said cover.

5. The dual-purpose dispensing container and utensil according to claim 4, wherein each one of said compartments further comprises an internal compartment, said internal compartment is configured to be pushed up towards said cover upon application of said pressure on said compartment, said lines of weakening are configured to tear upon pressure contact with said internal compartment.

6. The dual-purpose dispensing container and utensil according to claim 1, wherein each said cover is attached to each said top opening handle along a perimeter of said opening with an adhesive.

7. The dual-purpose dispensing container and utensil according to claim 6, wherein said adhesive is configured to remain on each said cover upon removal of said cover off of said top opening of each said compartment.

8. The dual-purpose dispensing container and utensil according to claim 6, wherein said adhesive is insoluble in aqueous medium.

9. The dual-purpose dispensing container and utensil according to claim 6, wherein said adhesive is digestible and/or removable from the alimentary tract of a user consuming said beverage or food.

10. The dual-purpose dispensing container and utensil according to claim 1, wherein each said cover is attached to said handle by heat melting along said perimeter surrounding said top opening of a compartment.

11. The dual-purpose dispensing container and utensil according to claim 1, wherein each said cover is configured to be only partially tearable from said upper surface of said handle.

12. The dual-purpose dispensing container and utensil according to claim 1, wherein said functional part is selected from a spoon bowl, a tea spoon bowl, a knife blade and fork teeth configured for preparing and consuming beverages or foods.

13. The dual-purpose dispensing container and utensil according to claim 1, wherein said ingredients are selected from sugar, coffee powder, tea leaves, spices, cream, butter dressings and mayonnaise.

14. The dual-purpose dispensing container and utensil according to claim 1, wherein said dual-purpose dispensing container and utensil is made of polymeric materials selected from styrene polymers, particularly polystyrene (PS), olefin polymers, polyethylene (PE), polypropylene (PP), polyethylene terphthalate (PET), polycarbonate (PC) and trifluoroethylene polymer, wherein said polymeric materials are configured to be chemically inert and physically durable when brought in contact with consumable liquids or foods.

15. The dual-purpose dispensing container and utensil according to claim 1, wherein said dual-purpose dispensing container and utensil is made of polymeric materials selected from styrene polymers, particularly polystyrene (PS), olefin polymers, polyethylene (PE), polypropylene (PP), polyethylene terphthalate (PET), polycarbonate (PC) and trifluoroethylene polymer, wherein said polymeric materials are configured to be durable at high temperatures of consumable liquid beverages or solid foods.

16. A kit comprising at least two dual-purpose dispensing containers and utensils as claimed in claim 1, wherein each one of said dual-purpose dispensing containers and utensils comprises ingredients contained in said compartments of said dual-purpose dispensing containers and utensils for introducing into a beverage or food.

17. The kit according to claim 16, wherein said ingredients are distributed among said compartments of said dual-purpose dispensing containers and utensils.

18. The kit according to claim 17, wherein said dual-purpose dispensing containers and utensils comprise functional parts selected from a spoon bowl, a tea spoon bowl, a knife blade and fork teeth configured for preparing and consuming beverages or foods.

19. The dual-purpose dispensing container and utensil according to claim 1, wherein the compartments are integrated within the handle.

20. The dual-purpose dispensing container and utensil according to claim 1, wherein each of the covers is removable off of the opening separately and independently form the covers closing the top openings of other compartments.

21. The dual-purpose dispensing container and utensil according to claim 1, wherein the cover is attached to the surface of the handle via soldering or welding.

22. The dual-purpose dispensing container and utensil according to claim 1, wherein the compartments comprise measured amounts of ingredients.

* * * * *